US011084288B2

(12) United States Patent
Barbet

(10) Patent No.: US 11,084,288 B2
(45) Date of Patent: Aug. 10, 2021

(54) PRINT HEAD OR INK JET PRINTER WITH REDUCED SOLVENT CONSUMPTION

(71) Applicant: Dover Europe Sàrl, Vernier (CH)

(72) Inventor: Bruno Barbet, Etoile-sur-Rhone (FR)

(73) Assignee: DOVER EUROPE SÀRL, Vernier (CH)

( * ) Notice: Subject to any disclaimer, the term of this patent is extended or adjusted under 35 U.S.C. 154(b) by 0 days.

(21) Appl. No.: 16/397,280

(22) Filed: Apr. 29, 2019

(65) Prior Publication Data

US 2019/0248143 A1 Aug. 15, 2019

Related U.S. Application Data

(63) Continuation of application No. 15/379,691, filed on Dec. 15, 2016, now Pat. No. 10,336,077.

(30) Foreign Application Priority Data

Dec. 22, 2015 (FR) ..... 15 63124

(51) Int. Cl.

| | |
|---|---|
| ***B41J 2/09*** | (2006.01) |
| ***B41J 2/165*** | (2006.01) |
| ***B41J 2/105*** | (2006.01) |
| ***B41J 2/185*** | (2006.01) |

(Continued)

(52) U.S. Cl.

CPC ..... *B41J 2/16517* (2013.01); *B41J 2/02* (2013.01); *B41J 2/09* (2013.01); *B41J 2/105* (2013.01); *B41J 2/185* (2013.01); *B41J 2002/022* (2013.01); *B41J 2002/031* (2013.01)

(58) Field of Classification Search

None

See application file for complete search history.

(56) References Cited

U.S. PATENT DOCUMENTS

| | | | |
|---|---|---|---|
| 3,373,437 | A | 3/1968 | Sweet et al. |
| 3,656,171 | A | 4/1972 | Robertson |
| 3,769,630 | A | 10/1973 | Hill et al. |

(Continued)

FOREIGN PATENT DOCUMENTS

| | | | |
|---|---|---|---|
| EP | 0249317 | A2 | 12/1987 |
| EP | 0 560 332 | A2 | 9/1993 |

(Continued)

OTHER PUBLICATIONS

Search Report issued in French Patent Application No. 1563124 dated Aug. 9, 2016.

(Continued)

*Primary Examiner* — Alejandro Valencia

(74) *Attorney, Agent, or Firm* — Pearne & Gordon LLP

(57) ABSTRACT

A print head of a binary continuous jet printer comprising: a plurality of nozzles for producing a plurality of ink jets in a cavity delimited by lateral walls, an upper wall and a lower wall, a sorting unit for separating drops or sections of one or more of the jets intended for printing from drops or sections that do not serve for printing, a slot, which passes through the lower wall, enabling the exit of ink drops intended for printing, a gutter for recovering drops or sections not intended for printing, a conduit for injecting gas into the cavity, and for making this gas circulate, in the cavity, to the plurality of nozzles for producing a plurality of ink jets in the cavity, then to the gutter.

17 Claims, 6 Drawing Sheets

(51) Int. Cl.
*B41J 2/02* (2006.01)
*B41J 2/03* (2006.01)

(56) References Cited

U.S. PATENT DOCUMENTS

| | | | | |
|---|---|---|---|---|
| 3,878,519 | A | 4/1975 | Eaton | |
| 3,947,851 | A | 3/1976 | Chen et al. | |
| 3,999,188 | A | 12/1976 | Yamada | |
| 4,035,811 | A | 7/1977 | Paranjpe | |
| 4,068,241 | A | 1/1978 | Yamada | |
| 4,086,601 | A | 4/1978 | Fillmore et al. | |
| 4,097,872 | A | 6/1978 | Giordano | |
| 4,217,595 | A | 8/1980 | Horike et al. | |
| 4,231,047 | A | 10/1980 | Iwasaki et al. | |
| 4,283,730 | A | 8/1981 | Graf | |
| 4,350,986 | A | 9/1982 | Yamada | |
| 4,403,227 | A | 9/1983 | Bertschy et al. | |
| 4,435,720 | A | 3/1984 | Horike et al. | |
| 4,442,440 | A * | 4/1984 | Eichinger | B41J 2/185 347/74 |
| 4,460,903 | A * | 7/1984 | Guenther | B41J 2/185 347/90 |
| 4,575,735 | A | 3/1986 | Weinberg | |
| 4,613,871 | A | 9/1986 | Katerberg | |
| 4,636,808 | A | 1/1987 | Herron | |
| 4,730,197 | A | 3/1988 | Raman et al. | |
| 5,049,899 | A | 9/1991 | Dunand et al. | |
| 5,160,939 | A * | 11/1992 | Bajeux | B41J 2/125 347/78 |
| 5,469,202 | A | 11/1995 | Stephens | |
| 5,502,473 | A * | 3/1996 | East | B41J 2/025 347/73 |
| 6,273,559 | B1 | 8/2001 | Vago et al. | |
| 6,364,470 | B1 | 4/2002 | Cabal et al. | |
| 6,450,628 | B1 | 9/2002 | Jeanmaire et al. | |
| 6,746,108 | B1 | 6/2004 | Jeanmaire | |
| 6,824,241 | B2 | 11/2004 | Sonnichsen et al. | |
| 7,192,121 | B2 | 3/2007 | Barbet et al. | |
| 8,162,450 | B2 | 4/2012 | Barbet | |
| 8,382,258 | B2 | 2/2013 | Xie et al. | |
| 8,382,259 | B2 | 2/2013 | Panchawagh et al. | |
| 9,028,024 | B2 | 5/2015 | Barbet et al. | |
| 9,475,287 | B2 | 10/2016 | Bonneton | |
| 2002/0171716 | A1 | 11/2002 | Jeanmaire | |
| 2003/0016275 | A1 | 1/2003 | Jeanmaire | |
| 2003/0043239 | A1 | 3/2003 | Yamada et al. | |
| 2003/0063166 | A1 | 4/2003 | Jeanmaire et al. | |
| 2003/0193551 | A1 | 10/2003 | Jeanmaire et al. | |
| 2004/0130590 | A1 | 7/2004 | West et al. | |
| 2006/0197810 | A1 | 9/2006 | Anagnostopoulos et al. | |
| 2007/0257971 | A1 | 11/2007 | Jeanmaire | |
| 2008/0143766 | A1 | 6/2008 | Hawkins et al. | |
| 2008/0231669 | A1 | 9/2008 | Brost | |
| 2008/0278548 | A1 | 11/2008 | Brost | |
| 2008/0284835 | A1 | 11/2008 | Panchawagh et al. | |
| 2010/0033543 | A1 | 2/2010 | Piatt et al. | |
| 2010/0045753 | A1 | 2/2010 | Barbet | |
| 2010/0110151 | A1 | 5/2010 | Griffin et al. | |
| 2011/0109677 | A1 | 5/2011 | Montz et al. | |
| 2011/0216136 | A1 | 9/2011 | Barbet et al. | |
| 2012/0026260 | A1 | 2/2012 | Gao et al. | |
| 2012/0281047 | A1 | 11/2012 | Barbet | |
| 2013/0307891 | A1 | 11/2013 | Barbet et al. | |
| 2013/0342597 | A1 | 12/2013 | Panchawagh | |
| 2016/0075897 | A1 | 3/2016 | Barbet et al. | |
| 2017/0028721 | A1 | 2/2017 | Barbet et al. | |

FOREIGN PATENT DOCUMENTS

| | | | |
|---|---|---|---|
| EP | 1 277 580 | A1 | 1/2003 |
| EP | 2 125 376 | | 12/2009 |
| FR | 2 906 755 | A1 | 4/2008 |
| FR | 2938207 | A1 | 5/2010 |
| FR | 2 975 632 | A1 | 11/2012 |
| GB | 2 098 546 | A | 11/1982 |
| JP | 6011364 | B2 | 10/2016 |
| RU | 2 055 319 | C1 | 2/1996 |
| WO | 90/06855 | A1 | 6/1990 |
| WO | 99/62717 | A1 | 12/1999 |
| WO | 02/100645 | A1 | 12/2002 |
| WO | 2008/117013 | A1 | 10/2008 |
| WO | 2012/038520 | A1 | 3/2012 |
| WO | 2014154830 | A1 | 10/2014 |

OTHER PUBLICATIONS

Written Opinion and translation for French Patent Application No. 1756810 dated Dec. 26, 2017.

Search Report for French Application No. 1756810 dated Dec. 26, 2017.

Search Report issued for European Application No. 18 204142 dated Feb. 28, 2019.

* cited by examiner

PRINT HEAD OR INK JET PRINTER WITH REDUCED SOLVENT CONSUMPTION

CROSS-REFERENCE TO RELATED APPLICATIONS

This is a continuation of prior U.S. application Ser. No. 15/379,691 filed Dec. 15, 2016, which claims priority of French Application No. 15 63124 filed Dec. 22, 2015. The content of each of these applications is incorporated by reference herein in its entirety.

TECHNICAL FIELD AND PRIOR ART

The invention relates to print heads of printers or binary continuous ink jet printers provided with a multi-nozzle drop generator. More particularly, it pertains to a print head or a binary continuous jet printer in which the consumption of solvent is close to the amount of solvent contained in the ink that reaches the printing support.

Continuous jet printers comprise an ink drop generator, and means for separating the trajectories of the drops produced by the generator and directing them to a printing support or to a recovery gutter.

The drop generator includes nozzles aligned on a nozzle plate along an axis X of alignment of the nozzles. During printing, ink jets are ejected in a continuous manner by these nozzles in a direction Z perpendicular to the nozzle plate. Among continuous jet printers may be distinguished deviated continuous jet printers and binary continuous jet printers. In deviated continuous jet printers, the drops formed from a nozzle during printing of a position of a printing support are deviated or not deviated. For each printing position and for each nozzle, a segment perpendicular to the direction of the movement of the printing support is printed. The deviated drops are deviated in such a way that they are going to hit the printing support on the part of the printed segment that has to be hit taking account of the pattern to be printed. The non-deviated drops are recovered by a recovery gutter. Deviated continuous jet printers comprise in general few injection nozzles, but each nozzle can print for each printing position of the support several pixels spread out on the printing segment as a function of the pattern to print. In binary continuous jet printers, the ink coming from a nozzle only prints one pixel per printing position. The pixel considered does not receive any drop or receives one or more drops, as a function of the pattern to print. Hence, for good printing rapidity, the nozzle plate comprises a large number of nozzles, for example 64, enabling the simultaneous printing of as many pixels as nozzles. Drops not intended for printing are recovered by a recovery gutter. Such printers and continuous print heads have been extensively described. Reference could also notably be made, with regard to the formation of jets, their breaking up to form drops, the deviation of the drops, to the "prior art" paragraphs of patents ascribed to the present applicant. For example, the U.S. Pat. No. 8,540,350 (FR 2 952 851) describes a method for avoiding diaphony between jets coming from nozzles adjacent to each other. Reference could also be made to the prior art described in the U.S. Pat. No. 7,192,121 (FR 2851495) relative to the positions of breaking up of jets depending on whether a drop formed by the breaking up of the jet is intended or not to hit the printing support.

In continuous jet printers, liquid inks are used. These inks comprise a solvent in which are dissolved the components of the ink. It is desirable that the ink dries quickly after it has been deposited on the printing support.

For this reason the solvents used are volatile. The most commonly used solvents are methyl ethyl ketone, also known as "MEK", acetone or instead alcohols such as for example, ethanol. The use of a volatile solvent leads however to drawbacks. Since it is volatile, the solvent escapes from the ink in the form of vapours.

Patent application WO 2012/038520 provides means for overcoming the drawback resulting from the presence of solvent vapour around the jets. Apart from a first part of vapours that can condense on the walls of the cavity in which the jets circulate, a second part leaves this cavity via a slot of the cavity through which the drops intended for printing exit. This second part mixes with the ambient air, which is thus contaminated. This contamination may lead to a refusal of a seal of environmental quality. When the solvent concentration exceeds a certain threshold, the air becomes unfit for respiration. Finally, if the concentration is high the air-solvent mixture is potentially explosive.

The solution provided by patent application WO 2012/038520 concerns, like the present invention, binary continuous jet printers. In these printers a small portion of the ink, of the order of 10%, is directed to the printing support. This signifies that a preponderant part of the ink emitted by the nozzles is directed to a recovery gutter. The different jets thus form together a liquid curtain that is directed to the recovery gutter. Only a small part of the ink ejected by the nozzles exits this curtain in the form of drops that are directed to the printing support. These drops leave the cavity via a slot parallel to the direction of alignment of the nozzles. The length of this slot is slightly greater than the distance separating the nozzles of the nozzle plate that are the furthest away from each other. The liquid curtain that moves to the recovery gutter has a velocity $V_j$. By viscosity effect, the air that is around this curtain is carried along in the same direction as the jets.

The air immediately in contact with the liquid is carried along at a velocity substantially equal to $V_j$. On moving away radially from the jet, the velocity of the air drops, until reaching a boundary where its velocity is low with respect to the velocity $V_j$.

The thickness of a so-called "boundary" layer is thus the distance separating the liquid-air boundary, and the boundary where air is no longer carried along by the liquid.

The solution provided by patent application WO 2012/038520 consists firstly in using an ink of which the Schmidt coefficient is close to 1. This has the effect that solvent vapours emitted by the ink remain practically confined to the inside of the boundary layer.

It then consists in placing the apex of the recovery gutter so as to recover, not only deviated drops not serving for printing, but also air loaded with the solvent vapour located in the two boundary layers that are found on either side of the jet curtain. To this end, the distance from the apex to the plane XZ is preferably less than the difference in deviation of the jets at the level of the apex reduced by the thickness of the boundary layer. The difference in deviation of the jets at the level of the apex is the distance measured along an axis Y perpendicular to the plane XZ, between the plane XZ and the position of a drop deviated at the level of this apex.

Patent application WO 2012/038520 gives the formula making it possible to calculate the thickness $\delta_2$ of the boundary layer as a function of the distance L between the nozzle plate and the apex, a numerical coefficient $\alpha$ between 3 and 5, typically 3, the kinematic viscosity of the air $v_a$ equal to $2.10^{-5}$ $m^2 \cdot s^{-1}$ and the velocity $V_j$ of the jets. This same document also explains how to regulate the position of the gutter in a direction Y perpendicular to the plane XZ. To compensate the loss of pressure inside the cavity in which the jets circulate, a flow of air of same flow rate or very slightly greater than the flow rate of the air sucked up by the gutter is injected substantially at the level of the nozzles. A large part of the injected air is sucked up at the level of the recovery gutter, and a small part exits via the outlet slot for the printing drops. The overpressure that is thus maintained in the cavity in which the jets circulate opposes the introduction of satellite drops or dust into this cavity.

But this solution is unsatisfactory and does not make it possible to recover to the maximum solvent vapours present in the cavity of the print head in which the jets circulate. Moreover, it limits the Schmidt coefficient of the ink employed.

BRIEF DESCRIPTION OF THE INVENTION

The subject matters of the present invention are devices and methods making it possible, on the one hand, to recover to the maximum solvent vapours present in the cavity of the print head in which the jets circulate. It also has the aim of reducing to the maximum the amount of solvent vapour that escapes to the exterior of said cavity via the slot for the passage of drops intended for printing. With respect to patent application WO 2012/038520, it also makes it possible to reduce the constraint on the Schmidt coefficient of the ink employed.

The subject matter of the invention is firstly a print head of a binary continuous jet printer comprising:

- a cavity for circulating jets,
- means for producing a plurality of ink jets in said cavity,
- means for separating drops or sections of one or more of said jets intended for printing from drops or sections that do not serve for printing,
- a slot open on the outside of the cavity and enabling the exit of the drops or sections of ink intended for printing,
- a recovery gutter for drops or sections not intended for printing.

Generally speaking, the cavity may be delimited laterally by walls, called lateral walls.

A wall, called upper wall, and a wall, called lower wall, delimit it along a direction of flow of the jets.

Lateral walls may be arranged on either side of a plane defined by the plurality of jets and at least in part parallel thereto.

According to a first aspect of the invention, the gutter may comprise:

- a $1^{st}$ part, which comprises an inlet slot for drops in the gutter, the width of this $1^{st}$ part diminishing in the sense of circulation of the drops in the gutter, a surface of this $1^{st}$ part forming an impact surface for drops not intended for printing;
- a restriction or a bend, the $1^{st}$ part being sloping from the inlet slot for the drops in the gutter up (or down) to the restriction, for example from the inlet slot for the drops in the gutter to a plane that goes through the outlet slot for the jets;
- a $2^{nd}$ part, for evacuating the fluid mixture (liquid and gas, mixture that results from the impact of the drops on the impact surface) from the restriction.

Thus, the drops or the sections of jet not intended for printing are sent to a gutter in which the flow of air is going to, by the geometry of the $1^{st}$ part of the gutter, accelerate the sucking up of the ink after impact of the drops on the impact surface, then take the ink along to the restriction, which is going to form a non-return element.

Preferably, the $2^{nd}$ part has a width that widens from the bend.

The $2^{nd}$ part of the gutter may be sloping from the restriction. If the $1^{st}$ part is sloping from the inlet slot for the drops in the gutter to the bend, the $2^{nd}$ part of the gutter may be sloping in the opposite sense. The 2 parts move apart the drops, which circulate in the gutter from the inlet of the latter and the plane defined by the jets. In other words, if the $1^{st}$ part is sloping from the inlet slot for the drops to a plane that goes through the outlet slot for the jets, the $2^{nd}$ part of the gutter may be sloping from the restriction while moving away from said plane, as the distance to the restriction increases.

Advantageously, the surface of the $1^{st}$ part of the gutter, forming an impact surface for the deviated drops, is at least in part convex.

The invention also relates to a method for operating, or printing, a print head according to the invention, in which drops or sections of ink intended for printing are sent to the outlet slot, whereas drops or sections that do not serve for printing are sent to the gutter where they are sucked up, with notably the aforementioned advantages. The invention may thus be implemented during a printing method.

According to a second aspect of the invention, which may be taken in combination, or not, with the first aspect above, means may be provided for injecting gas into the cavity, and for making this gas circulate, in the cavity, in the direction of the means for producing a plurality of ink jets in said cavity, then to the gutter.

It is thus possible to generate a circulation of air that is going to make it possible to bring solvent vapours to the gutter, even from areas of the cavity that are situated outside of the boundary layer.

In most cases, the gas injected via the injection conduit will be air, but another gas may be injected, in particular nitrogen.

The gas can then circulate, in the cavity, in an ascending manner in the direction of the upper wall, to the means for producing a plurality of ink jets in said cavity, then, in a descending manner, to the gutter and/or to the lower wall of the cavity.

The gas injected is directed in the direction of the means that are going to make it possible to produce a plurality of ink jets in said cavity. Under the effect of stoppage of the flow of gas by these means, and on account of the air drag effect of the deviated jets (or not intended for printing), the gas is then carried along downstream in the same direction as the jets, and is sucked up into the gutter, due to the low pressure present at the level of the inlet thereof. Hence, solvent vapours that were not inside the boundary layer are nevertheless brought back to the gutter. These vapours, which were not found in the boundary layer, have according to the inventors two origins:

- the first stems from the fact that molecules of solvent escape from the boundary layer in the course of the journey of the link between the means for producing a plurality of jets and the gutter;
- the second stems from the effect of impact or collision, against a wall of the gutter, of drops recovered by the gutter. Under the effect of impact against this wall gases loaded with vapour are driven along outside of the gutter and the exchange surface of the material initially contained in the drop with the environment increases significantly.

Thanks to the drag effect of gases arriving in the direction towards the means for producing a plurality of jets and to the vortex produced by these gases, all the vapours, which for one reason or another have escaped from recovery by the gutter, are brought back thereto.

Air, loaded with solvent vapour, which could escape from the recovery gutter would be carried along firstly to the nozzle plate by the injected flow of gas.

A part at least of these vapours returns to the recovery gutter. Another part makes one or more turns in the cavity. It may be noted that if the solvent vapour pressure in the cavity increases, the amount of vapour absorbed by the gutter also increases, such that the vapour pressure in the cavity has a tendency to remain substantially constant.

It may be noted that the interest in employing an ink of which the Schmidt coefficient is close to 1 is to confine a major part of the solvents inside the boundary layer. Thanks to the invention, vapours that escape from this boundary layer are recovered.

The constraint on the value of the Schmidt coefficient is thus reduced, it may thus be chosen up to a high value, for example up to 5 or be strictly greater than 1 and less than 5.

The means for injecting gas into the cavity may comprise a conduit, which emerges at least in part facing the gutter, or a face that laterally delimits the gutter on the side of the cavity, with respect to a plane ($P_0$) defined by the path of the jets intended for printing the drops.

In the preceding case, with a conduit emerging in the cavity, the distance (b) between the lateral walls of the cavity is preferably less than the distance between an upper wall of the cavity and the point of the conduit the closest to this upper wall.

In a variant, the means for injecting gas into the cavity comprise a conduit, which emerges in the cavity while passing through the lower wall.

Also preferably, in a print head according to the invention, the path of gas injected into the cavity, in the direction of the means for producing a plurality of ink jets, is longer than the path along a direction perpendicular to a plane ($P_0$) defined by the path of the jets intended for printing.

The plane ($P_0$), defined by the path of the jets intended for printing drops, separates the inlet, in the cavity, from the means for injecting gas therein, and the gutter or the inlet of the gutter. Similarly, the outlet slot is arranged between the inlet, in the cavity, of the means for injecting gas therein, and the gutter.

The means for injecting gas into the cavity may enable an injection of gas along a direction at least in part perpendicular, or at least in part parallel, to a plane ($P_0$) defined by the path of the jets intended for printing.

A deviation surface of a gas introduced into the cavity may be provided on the path of a gas coming from the means for injecting gas into the cavity.

It is for example a surface of a stud or an obstacle or a guide arranged in the path of a gas introduced into the cavity.

The invention thus also relates to a print head of a binary continuous jet printer comprising:

- a cavity for circulating jets, delimited by lateral walls, and by an upper wall and a lower wall,
- means for producing a plurality of ink jets in said cavity,
- means for separating drops or sections of one or more of said jets intended for printing from drops or sections that do not serve for printing,
- a slot, which passes through the lower wall, open on the outside of the cavity and enabling the exit of drops or sections of ink intended for printing,
- a gutter for recovering drops or sections not intended for printing.

The print head further comprises a conduit for injecting gas into the cavity, which emerges in the latter while passing through the lower wall.

In a variant, the print head comprises a conduit for injecting gas along a direction at least in part perpendicular to a plane ($P_0$) defined by the path of jets intended for printing, a stud or a deviation surface or a deviation obstacle making it possible to direct a gas, thereby introduced in the cavity via this conduit, in an ascending manner, in the direction of the upper wall.

The gas introduced is going to circulate, in the cavity, in the direction of the means for producing a plurality of ink jets in said cavity, then to the gutter, thus generating a circulation of air, according to what has been explained above. Similarly, what has been described above with reference to the drag effect that gases arriving in the cavity have on solvent vapours also applies here.

This print head may comprise one or more of the characteristics described above with reference to the first aspect of the invention and/or one or more of the characteristics described above with reference to the second aspect of the invention.

Whatever the embodiment, the slot, open on the outside, may advantageously have a shape that diverges from the inside to the outside of the cavity.

The invention also relates to a method of operating, or printing, a print head as described above or in the present description, in which drops or sections of ink intended for printing are sent to the slot, whereas drops or sections that do not serve for printing are sent to the gutter, where they are sucked up; during these different phases, a gas circulates in the cavity to the means for producing a plurality of ink jets in said cavity, then to the gutter.

The invention may thus be implemented during a printing method.

Whatever the considered embodiment of a device or method according to the invention, the means for separating drops or sections of one or more of said jets intended for printing from drops or sections that do not serve for printing may comprise at least one electrode formed against, or in, one of these walls.

At least one electrode may be flush with the surface of the wall in question. Thus drops or sections that do not serve for printing are deviated by electrostatic effect, of at least one electrode, on the drops.

Preferably, the inlet slot of the gutter is arranged at the bottom of the wall against, or in, which at least one of these electrodes is formed.

A part of the wall against which at least one electrode is formed advantageously moves away from the plane defined by the plurality of jets.

A print head or a method according to the invention may comprise or involve one or several of the following features:

- an edge of the inlet slot of the gutter may be situated directly in line with one of the edges of the slot, which optimises the recovery of drops not intended for printing;
- and/or the gutter for recovering drops not intended for printing may have a downstream wall, or part, of which a part is situated inside the cavity;
- and/or lateral walls of the cavity can be arranged on either side of a plane ($P_0$) defined by the plurality of jets, and arranged at least in part parallel thereto;
- and/or the distance (b) between the lateral walls being less than the distance between the upper wall of the cavity and the point of the conduit the closest to this upper wall.

an/or the invention the apex of the recovery gutter is situated at a distance L from the plane XZ less than or equal to the difference in deviation of the jets at the level of this apex reduced by the thickness of the boundary layer around the jets deviated at the level of this apex; this last characteristic makes it possible to improve recovery, not only of ink not serving for printing but also of vapours present inside the boundary layer surrounding these jets.

A device or method according to the invention enables a reduction in the amount of solvent vapour escaping to the outside of a print head of a continuous binary jet printer.

According to another aspect, the dynamic pressure of the gas injected into the cavity is adjusted so that a resultant of a vector-velocity of the gaseous flow is directed in the direction Z in the upstream-downstream sense. Hence the gaseous flow does not bring about any perturbation to the trajectory of drops intended for printing, which follows a trajectory merged with the axis Z of the nozzle from which they exit. In fact, the gaseous flow is going to "feed" the jet curtain; the pressure effect (by the injected gas) is going to be more or less equal to, or is going to compensate, the suction effect. The gaseous flow does not bring about any perturbation.

BRIEF DESCRIPTION OF THE DRAWINGS

An example of embodiment of the invention will now be described with reference to the appended drawings in which.

In the figures, similar or identical technical elements are designated by the same reference numbers.

DETAILED DESCRIPTION OF EMBODIMENTS

Figure 1:
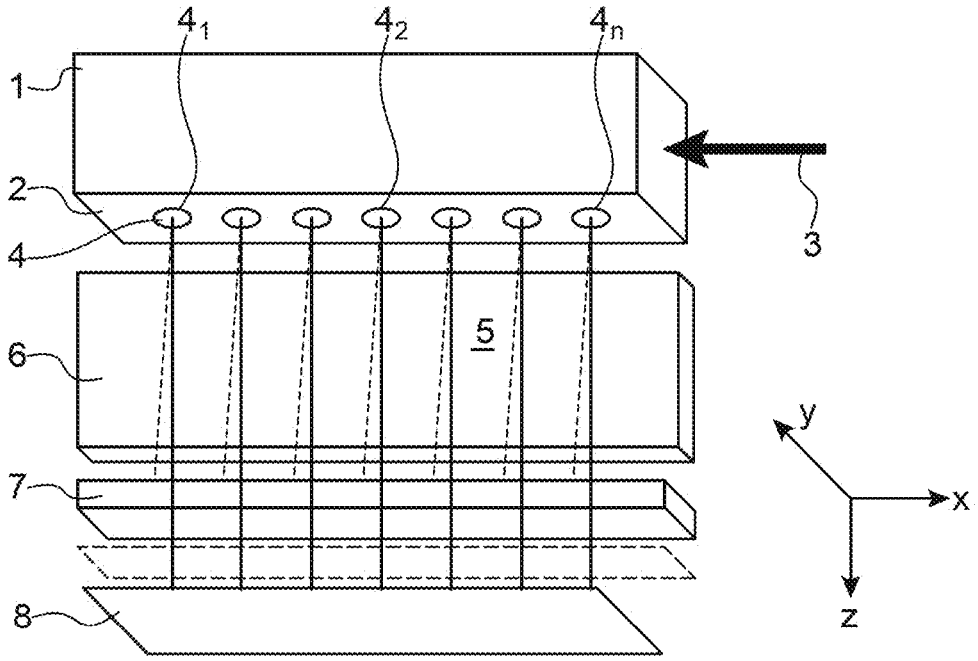
FIG. 1 represents a schematic cavalier view of a print head mainly showing the components of the print head situated downstream of the nozzles.

A general structure of print head is explained below, with reference to FIG. 1.

The head includes a drop generator 1. This generator comprises a nozzle plate 2 on which are aligned, along an axis X (contained in the plane of the figure), a whole number n of nozzles 4, of which a first $\mathbf{4}_1$ and a final nozzle $\mathbf{4}_n$.

The first and final nozzles ($\mathbf{4}_1$, $\mathbf{4}n$) are the nozzles the farthest away from each other.

Each nozzle has an axis of emission of a jet parallel to a direction or an axis Z (situated in the plane of FIG. 1), perpendicular to the nozzle plate and to the axis X mentioned previously. A third axis, Y, is perpendicular to each of the two axes X and Z, the two axes X and Z extending in the plane of FIG. 1.

In the figure may be seen the nozzle $\mathbf{4}_x$. Each nozzle is in hydraulic communication with a pressurised stimulation chamber. The drop generator comprises as many stimulation chambers as nozzles. Each chamber is equipped with an actuator, for example a piezoelectric crystal. An example of design of a stimulation chamber is described in the document U.S. Pat. No. 7,192,121.

Downstream of the nozzle plate are located means, or sorting unit, 6 that make it possible to separate drops intended for printing from drops or sections of jets that do not serve for printing.

The drops emitted or sections of jets emitted by a nozzle and intended for printing, follow a trajectory along the axis Z of the nozzle and are going to hit a printing support 8, after having passed via an outlet slot 17. This slot is open on the outside of the cavity and enables the exit of drops of ink intended for printing; it is parallel to the direction X of alignment of the nozzles, the axes of direction Z of the nozzles passing through this slot, which is located on the face opposite to the nozzle plate 2. It has a length at least equal to the distance between the first and the final nozzle.

In the remainder of the present application as well as in the claims, the term "cavity" designates the area of space in which ink circulates between the nozzle plate 2 and the outlet slot 17 for drops intended for printing or between the nozzle plate and the recovery gutter. The nozzle plate 2 in fact forms an upper wall of the cavity.

The drops emitted or sections of jets emitted by a nozzle and not intended for printing are deviated by the means 6 and are recovered by a recovery gutter 7 then recycled. The gutter has, in the direction X, a length at least equal to the distance between the first and the final nozzle.

Sectional views of various examples of print head structure, according to various aspects of the invention, are explained in a more detailed manner below, with reference to FIGS. 2A-4. Aspects common to these different embodiments will firstly be explained. These sections are taken along a plane parallel to the plane YZ, and containing the axis Z of a nozzle 4. The representation of each section keeps the same shape over the distance going, along the direction X (perpendicular to the plane of each of the FIGS. 2A-4), from the first nozzle $\mathbf{4}_1$ to the final nozzle $\mathbf{4}_n$. In these figures, only the cavity 5 in which the jets circulate is represented.

Figure 3:
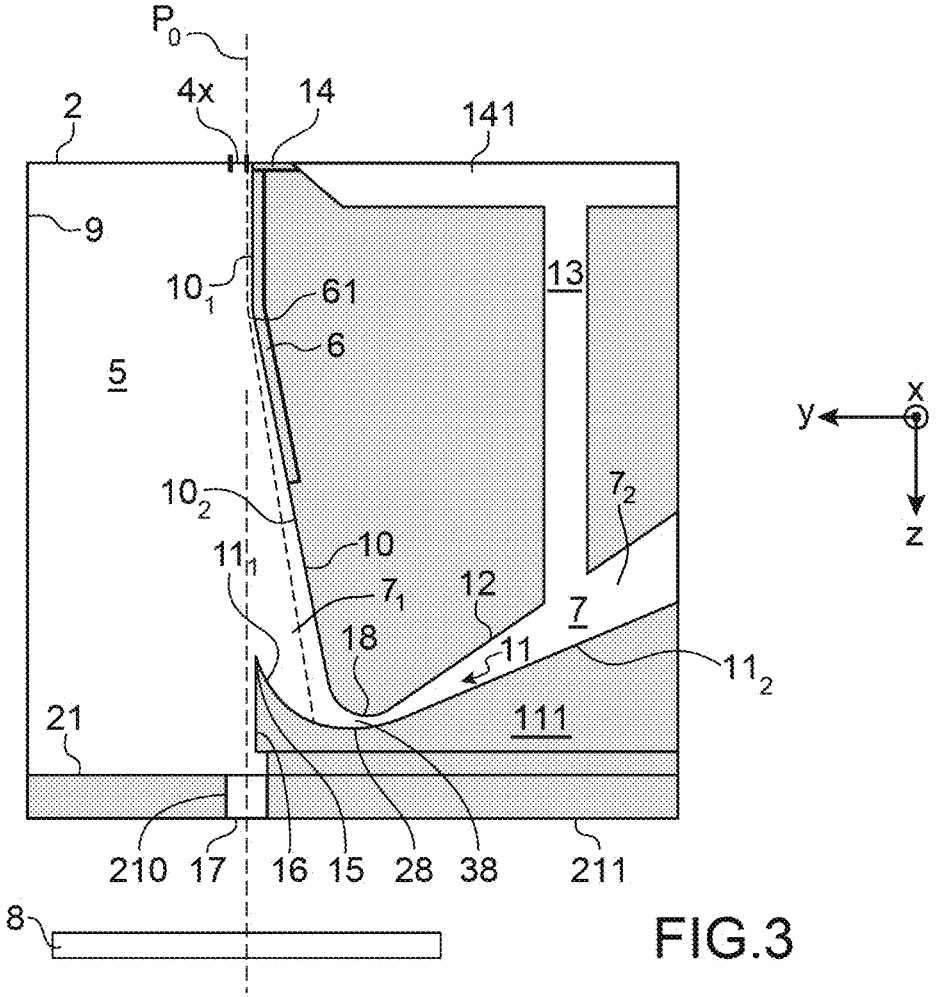
FIG. 3 represents a sectional view of a cavity of a print head according to an aspect of the invention, the section being taken along a plane parallel to the plane YZ and containing one of the axes Z of a nozzle.

$P_0$ designates the plane that goes through the nozzle 4*x* and which is parallel to the plane XZ. This plane is perpendicular to each of FIGS. 2A-4 and goes through all the nozzles, which are aligned along X. It also goes through the slot 17. A plot of this plane is represented in FIG. 3 in broken lines.

The upper part of the cavity is delimited by the wall 2, which also forms, or comprises, the nozzle plate or comprises nozzles. The lower part of the cavity is delimited by a lower wall 21, traversed by the slot 17, and by a part of the gutter 7. Walls 9 and 10 limit the lateral extension, along the axis Y.

The cavity comprises in addition, on one side of the plane $P_0$, a lateral wall 9, preferably parallel to the plane $P_0$ and contiguous with the nozzle plate 2. A wall 10, situated on the other side of the plane $P_0$, faces the wall 9. The cavity is thus delimited, on either side of the plane $P_0$, by these 2 walls 9 and 10. By convention, the side of the plane $P_0$ where the wall 10 and the gutter 7 are located is called first side of this plane, the other side (where the wall 9 is located), is called second side.

The wall 10 has ends, along the direction X, which are contiguous with the nozzle plate 2. In the part which is close to the nozzle plate 2 and over a length that is, preferably, slightly greater than the distance between the first $\mathbf{4}_1$ and the final nozzle $\mathbf{4}_n$, this wall may comprise a slot 14, which will make it possible to suck up ink that is deposited on the nozzle plate or in its vicinity.

At the bottom of this wall 10 is located the inlet slot of the recovery gutter 7, 70 to make it possible to recover drops that are deviated in order that they do not pass through the slot 17.

The gutter may be placed in hydraulic communication with the slot 14, by means of a conduit 13 that emerges in the gutter and which is situated to the rear of the wall 10 with respect to the plane $P_0$.

The means 6 for selecting and deviating drops not intended for printing are flush on the wall 10. These means mainly comprise electrodes. They are intended to be connected to powering up means, not represented in the figure.

Preferably, the distance between the wall 10 and the plane $P_0$, measured along the direction Y, perpendicular to the plane $P_0$, is, going from the plate 2, firstly constant; this corresponds to a $1^{st}$ part $\mathbf{10}_1$ of the wall 10, which is substantially parallel to $P_0$. Then, in a second part $\mathbf{10}_2$, further from the plate 2 than the $1^{st}$ part $\mathbf{10}_1$, from a point 61 of incline of the wall 10, the distance between the wall 10 and the plane $P_0$ increases with the moving away of the nozzle plate.

This structure enables the wall 10 to be close to the plane $P_0$, and parallel thereto, in a $1^{st}$ part of the cavity situated in the vicinity of the nozzles $\mathbf{4}_x$, in the place where the path of the drops is hardly modified, even when drops situated more downstream on this path are deviated to enter into the recovery gutter 7.

This is what may be seen in FIGS. 2A-4, where a path of drops is deviated to the gutter 7, 70: the upper part of the jet is not, or is only very slightly, deviated, whereas, from a point 61 of inclination of the wall 10, the jet moves away more and more, almost linearly, from the plane $P_0$. This could be termed a ballistic path of the jet downstream of the electrostatic field area.

A lower part of the wall 10 and a wall 12, situated to the rear of the wall 10 with respect to the plane $P_0$, defines, facing a wall 11, a conduit, or gutter 7, 70 for evacuating drops that will not be used for printing.

The walls 10 and 12 are, preferably, contiguous with each other, the reference 18 designating the junction line of these two walls 10 and 12; this line is parallel, or substantially parallel, to the direction X. They form an upper wall of the gutter.

The wall 11 forms a lower wall of the gutter. It comprises a $1^{st}$ part $\mathbf{11}_1$, the most upstream in the sense of circulation of the drops in the conduit 7, 70 and a second part $\mathbf{11}_2$, the most downstream.

The potential conduit 13 may emerge in the upper wall 12 and hydraulically connect the recovery gutter 7, 70 to a conduit 141 hydraulically connected to the slot 14.

The reference 28 designates a junction line of the parts $\mathbf{11}_1$ and $\mathbf{11}_2$ of the wall 11; this line is parallel, or substantially parallel, to the direction X and to the line 18.

The part $\mathbf{11}_1$ the most upstream, at the inlet of the conduit 7, 70 of the lower wall 11, terminates by an end part 15, which, advantageously, constitutes its apex (or summit). It is the point of the surface 11 that is the closest to the plane $P_0$.

Preferably, this apex 15 also forms part of a wall 16 that is parallel to the plane $P_0$ and which forms one of the walls surrounding or delimiting the outlet slot 17. In other words, the point the most upstream of the gutter is directly in line with the outlet slot 17 of the cavity. This makes it possible to optimise the recovery of drops: thanks to this configuration, any drop deviated, even slightly, will be recovered by the gutter.

The slot 17 constitutes an opening of the cavity 5 through which pass drops intended for printing. In FIG. 3, a dotted line materialising the axis of the nozzle $\mathbf{4}_x$ has been represented. This axis goes through the centre of the slot 17.

Another wall of the cavity is constituted by the wall 21: it is substantially parallel to the plate 2, but the furthest away therefrom in the cavity 5. In other words, it is situated on the side of the outlet slot 17. An end of this wall may form an inlet edge of the slot 17, facing the wall 16 already mentioned above.

A wall 210, substantially perpendicular to the wall 21, delimits, with the wall 16, the outlet slot 17: the drops are going to circulate between these 2 walls, before exiting the slot 17 and being crushed on the printing support 8.

Figure 2A:
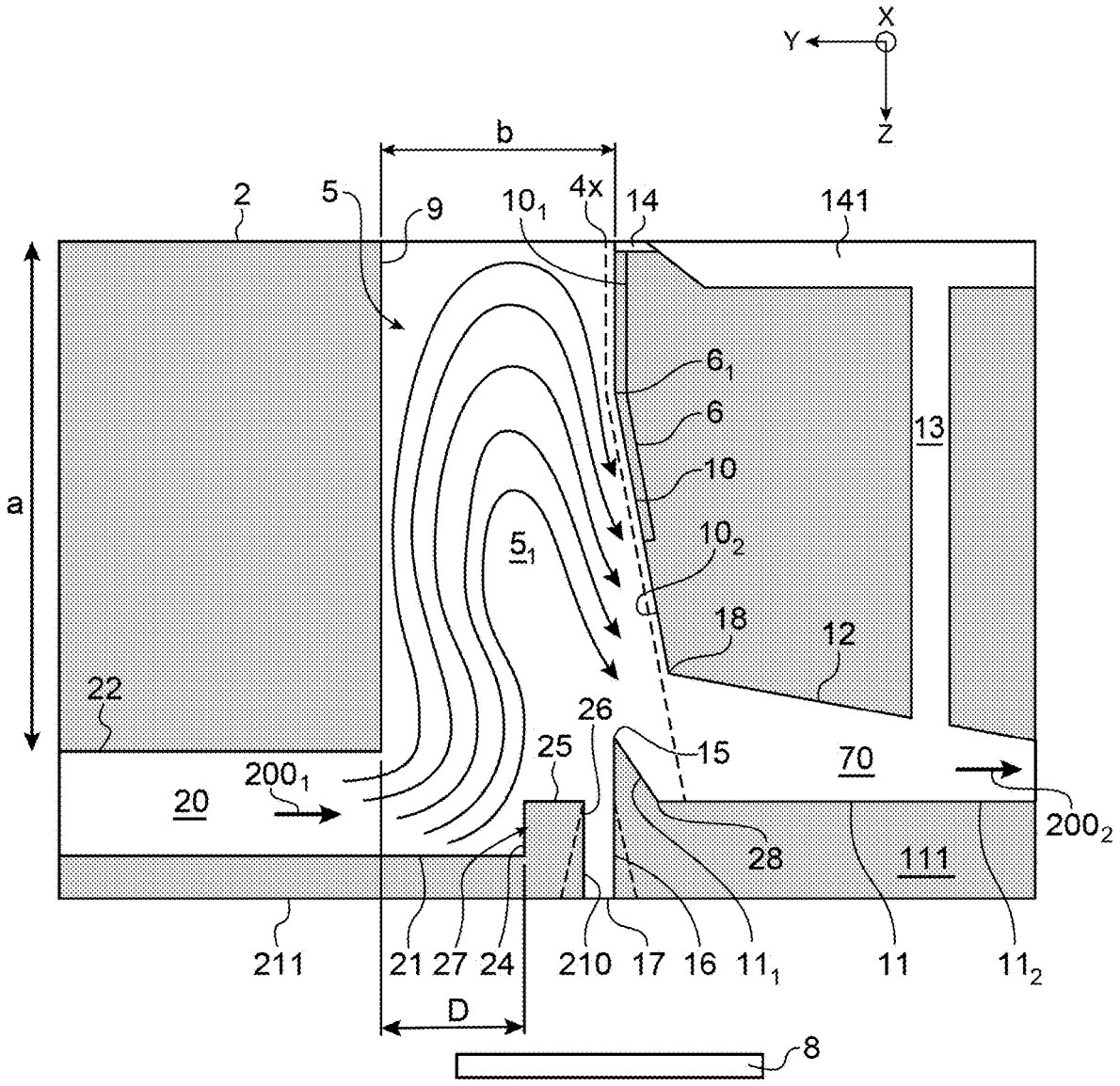
FIG. 2A represents a schematic section of a cavity of a print head, according to an aspect of the invention, this section being taken along a plane parallel to the plane YZ and containing one of the axes Z of a nozzle.

In a variant, the walls 16 and 210 move away from each other, as represented in broken lines in FIG. 2A. This funnel shape makes it possible to avoid capturing or intercepting drops which could deviate slightly from their trajectory at the outlet of the cavity 5 but which could all the same be directed to the printing support. This shape of the walls 16 and 210 may be applied to the other modes or examples of embodiment of the cavity, described in the present application.

Finally, the reference 211 designates the exterior surface of the cavity, into which the outlet of the slot 17 emerges.

An example of operation of these cavities is as follows.

A continuous ink jet is emitted by the print head. The deflection of this jet is commanded by electrodes 6 to create, as a function of the pattern to print and the position of the support 8, drops intended or not for printing.

Drops intended for printing move along the axis Z (in the plane $P_0$) and pass through the slot 17.

Drops not intended for printing are deviated from the axis Z (or from the plane $P_0$), and along a trajectory that brings them to strike the lower wall 11 of the gutter 7, 70.

Since the gutter is connected to a low pressure source, the ink of these drops, which have stricken the wall 11, exit, with air, the cavity 5 via the gutter.

Furthermore, the conduit 13 and the slot 14 can maintain a slight low pressure at the level of the nozzle plate 2. This low pressure makes it possible to absorb ink which, by capillarity, is deposited on the nozzle plate 2.

In FIG. 2A is represented a particular aspect of an embodiment of the invention.

The reference 70 designates a recovery gutter, for example of the type known from the prior art according to the teaching of document WO 2012/038520. Pumping means (not represented in the figure) may be connected to the gutter to suck up ink that enters into the latter.

A lateral conduit 20 enables the cavity 5 to be placed in communication with a source of overpressure, not represented.

One of the walls of this conduit 20 is the wall 21; a $2^{nd}$ wall 22, which faces the $1^{st}$ wall and which is parallel to it, re-joins the wall 9, in which an opening enables the conduit to emerge in the cavity 5. The conduit 20 is thus arranged laterally, at the bottom of the cavity, that is to say, along the axis Z, on the side opposite to the plate 2. It is also arranged, laterally, on the side opposite to that in which the gutter 70 emerges. This conduit 20 is going to make it possible to make circulate, in the direction of the cavity 5 and substantially parallel to the wall 21, a flow of air or gas, as represented by the arrow $\mathbf{200}_1$.

In the cavity are also provided means 27, which are going to make it possible to deviate, before it reaches the space above the slot 17, the flow $\mathbf{200}_1$ from its initial trajectory, which is substantially parallel to the wall 21. Thus, this gaseous flow is going to rise to the upper part of the cavity, that is to say to the plate 2. In the embodiment illustrated, these means 27 comprise for example an obstacle, such as a plate or (here) a stud, which the flow $\mathbf{200}_1$ is going to encounter and which is going to make it possible to be deviated as indicated above. The 1st wall 21 may be terminated, before the slot 17, by this obstacle.

The stud 27 has, in the plane of the figure, a substantially rectangular or square shape. It is delimited, on the side of the conduit 20, by a face 24, parallel to the plane $P_0$. D designates the distance between the plane of the wall 24 and the wall 9. This distance D is less than the distance separating the wall 9 from the plane $P_0$.

The upper part of the stud 27 is formed by a flat part 25, substantially parallel to the nozzle plate 2.

Finally a part or wall 26, parallel to the plane $P_0$ forms a wall of the slot 17 opposite to the wall 16. This wall 26 is situated in the extension of the wall 210, already described above. The jet circulates between these walls 16, 26, before exiting the slot 17 and being crushed on the printing support 8.

The walls 16 and 26 are situated on either side of the plane $P_0$. It may be noted that the part 111, situated under the surface 11, may be laterally moveable, along the direction Y, in order to better position the apex 15 at the start of operation (which may also be the case for the configuration of FIG. 3). In all cases, in operation, the walls 16 and 26 are preferably situated at equal distance from the plane $P_0$.

The operation of this cavity may be as follows: a gaseous jet $\mathbf{200}_1$ is sent via the conduit 20 to the cavity 5. The air that thus enters into the cavity 5 is deviated by the wall 24 of the means 27 and is directed to the upper part of the cavity, in the direction of the nozzle plate 2. The air firstly follows an ascending path, in the vicinity of the wall 9, then a descending path, downstream, inside the boundary layer that surrounds the jets.

These effects are favoured for certain configurations of the cavity: if "a" designates the distance, measured along Z, between the point of intersection between the walls 9 and 20, and the nozzle plate 2 and "b" the distance measured along Y, between the walls 9 and 10, then the condition a>b favours the effects described above, while allowing a vortex to be established; if a<b, then, the vortex can only be established with greater difficulty (air risks directly impacting the jet curtain).

In FIG. 2A is represented the circulation of gas, materialised by curved arrows, obtained in the cavity and which results from the means 20 for injecting gas and the means 27 for deviating the flow of gas. This representation illustrates the fact that the gas is going to describe, inside the cavity 5, a vortex which tends to concentrate air in the vicinity of the trajectory of the deviated jets.

Thus, vapours that are located far from the trajectory of the jets deviated are brought back thereto, are then absorbed by the gutter 70 and are evacuated as illustrated in FIG. 2A by the arrow $\mathbf{200}_2$.

The gaseous vortex generated by the circulation of gas in the cavity 5 is stable, consequently all the drops intended for printing are deviated by the same amount with respect to the axis Z. The positions of the printing drops on the printing support with respect to each other will thus be independent of the deviation value. The potential deviation is sufficiently small so that drops continue to pass through the slot 17 without striking the walls 16 and 26.

During the operation of the cavity, a suction is imposed at the outlet of the gutter 70 by pumping means (not represented in the figure). Furthermore, a positive pressure is imposed at the inlet of the conduit 20 (to make the flow of air $\mathbf{200}_1$ circulate) by pumping means (not represented in the figure).

It is thus possible to obtain a pressure equal to, or close to, the external pressure $P_{ext}$, at a point or in a central area $\mathbf{5}_1$ of the cavity. As a function of the pressure values imposed at the outlet of the gutter 70 and at the inlet of the conduit 20, the position and the volume of this central area $\mathbf{5}_1$ can vary.

The presence of this area is favourable, because, if the pressure in the cavity is less than the external pressure, air is going to enter into the cavity 5 and perturb the flow of the jets; if the pressure in the cavity is greater than the external pressure, air is going to exit the cavity 5 while carrying along solvent vapours.

The flow of air in the cavity is going to circulate around the area $\mathbf{5}_1$ of pressure close to the external pressure $P_{ext}$.

Figure 2B:
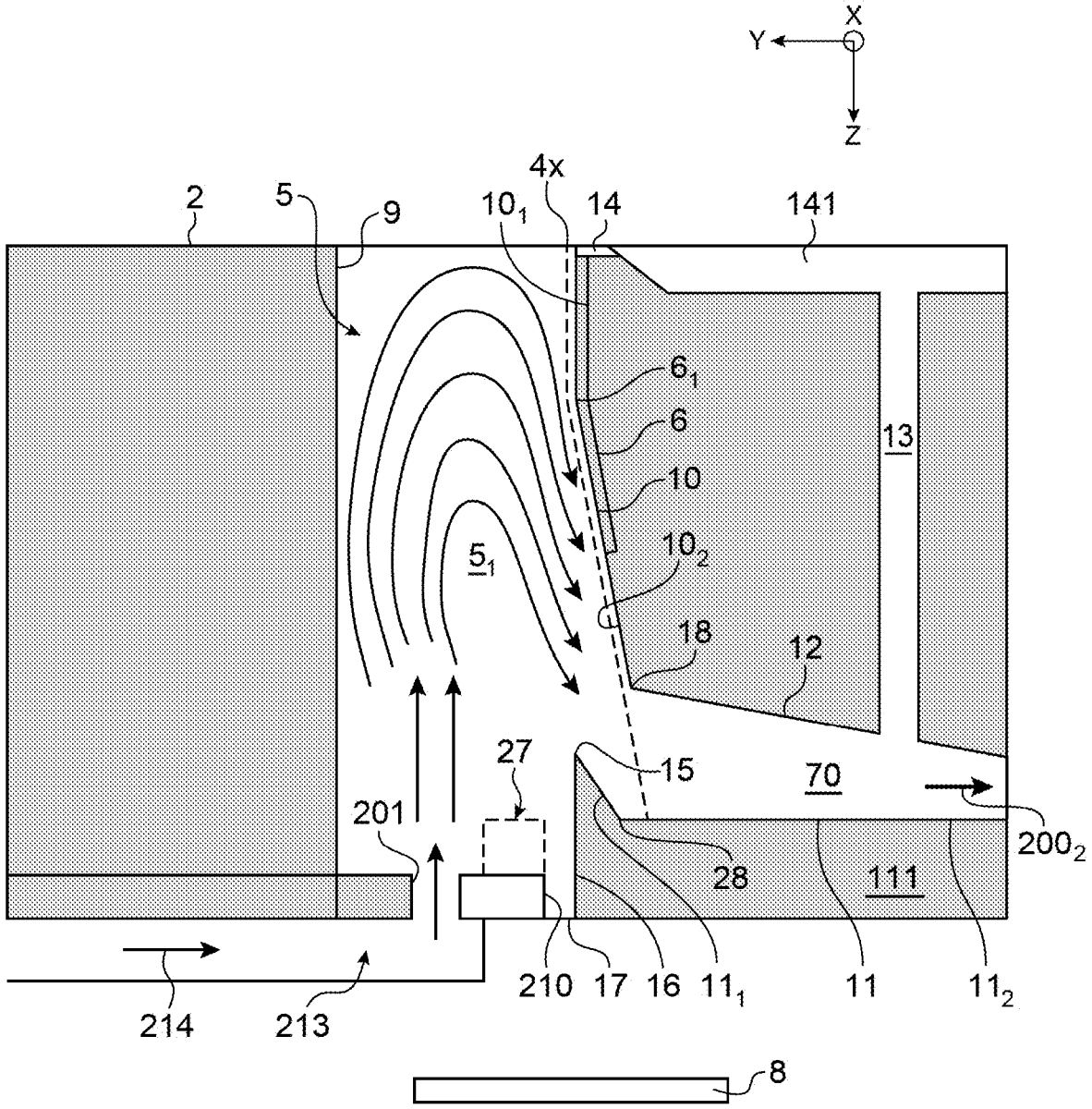
FIG. 2B represents a variant of the structure of FIG. 2A.

A variant of the structure of FIG. 2A is illustrated in FIG. 2B, where a conduit 213, which, for example, passes along the external surface 211, emerges in the cavity 5 via an orifice 201 produced in the wall 21. This conduit 213 enables the cavity 5 to be placed in communication with a source of overpressure, not represented.

This conduit 213 is going to make it possible to circulate, in the direction of the cavity 5 and substantially parallel to the wall 9, a flow of air or gas, as represented by the arrow 214.

The operation of this cavity may be as follows: a gaseous jet 214 is sent via the conduit 213 to the cavity 5. Air thus enters into the cavity 5 and is directed to the upper part of the cavity, in the direction of the nozzle plate 2. The air firstly follows an ascending path, in the vicinity of the wall 9, then a descending path, downstream, inside the boundary layer that surrounds the jets. The presence of means such as the means 27 (represented in broken lines in FIG. 2B) is not necessary, since the flow of gas circulates, as soon as it enters into the cavity, from the bottom thereof to the top.

During the operation of the cavity, a suction is imposed at the outlet of the gutter 70 by pumping means (not represented in the figure). Furthermore, a positive pressure is imposed at the inlet of the conduit 213 (to make the flux 214 circulate) by pumping means (not represented in the figure).

The other aspects described above with reference to FIG. 2A also apply to the structure of FIG. 2B (circulation of gas, gaseous vortex, pressure equal to, or close to, the external pressure $P_{ext}$, at a point or in a central area $\mathbf{5}_1$ of the cavity).

FIG. 3 represents a schematic section of a print head complying with another particular aspect of an embodiment of the invention. The embodiment of this FIG. 3 does not comprises a conduit 20, emerging in the cavity.

In this figure it may be seen that the gutter 7 comprises a 1st part $\mathbf{7}_1$, which begins at the inlet slot for drops in the gutter and of which the section, or the width, reduces, preferably progressively, on moving away from the plane $P_0$ and the plate 2. This makes it possible to confer to the flow of air that circulates in the gutter a velocity that increases from the inlet of the gutter.

This first part $7_1$ has the shape of a conduit sloping towards the bottom of the figure, or to a plane parallel to the plane XY and which passes through the outlet slot 17.

A $2^{nd}$ part $7_2$ follows on from the $1^{st}$ part $7_1$, in the sense of circulation of drops recovered by the gutter 7. The section of this $2^{nd}$ part, or its width, increases, preferably, on moving away from the plane $P_0$ and on coming closer to the plate 2. This shape makes it possible to create a Venturi effect. The flow of air that circulates in this part of the gutter has a velocity that decreases. A constant section of this 2nd part, or its width, is possible within the scope of the invention, but then without creation of Venturi effect.

The gutter has, in this second part $7_2$, the shape of a conduit sloping towards the top of the figure, or towards the plane of the nozzle plate, in order to reduce the size of the device: an incline of this second part $7_2$ towards the bottom of the figure would lead to an increased distance between the nozzle plate 2 and the external surface 211, in which the outlet of the slot 17 is produced. It is thus sought to have a mean angle, between the 2 parts $7_1$ and $7_2$, less than or equal to 90°.

The section or the width of the conduit 7 is for example measured in a plane perpendicular to the surface of one of the walls 10, 11, 12 that delimit the gutter. The sections of the different parts are calculated so that the gutter generates a pressure difference of around 150 mbars, or between 50 mbars and 500 mbars.

In an area situated between the $1^{st}$ part $7_1$ and the $2^{nd}$ part $7_2$, and in the vicinity of this area, the conduit 7 forms a curved portion, or a restriction or a bend 38, which makes it possible to avoid a return of drops of ink to the cavity 5 and which is going to define an area of change of incline of the gutter, this restriction 38 forming the part of the gutter the farthest away from the plane of the plate 2.

The progressive reduction in section of the $1^{st}$ part $7_1$ is going to make it possible, firstly, to capture, with a good efficiency, drops in a section, forming the inlet and the part of widest section of the gutter. The drops are then taken along, in this $1^{st}$ part, to the wall 11 on which they are going to be crushed, which is going to form a diphasic air-liquid mixture which is then sucked up to the restriction 38, which, through its curved shape and its narrowness (width between 50 μm and 300 or 400 μm), will not enable a return of this mixture to the $1^{st}$ part $7_1$.

Advantageously, the $1^{st}$ part $11_1$ of the lower wall 11, is at a distance d from the plane of the nozzle plate 2, which decreases when the distance to the plane $P_0$ decreases. The same applies to the portion of the wall 10 which is situated upstream of the line 18. In other words, the more a point, on the surface $11_1$ (respectively 10), is close to the plane $P_0$, the closer it is, also, to the plane of the plate 2. This part $11_1$ delimits a volume that is situated above the surface $11_1$ and which the ink passes through before spreading on the wall $11_1$, This volume is preferably at least in part substantially concave, which is favourable to the capture of drops that are crushed on this surface $11_1$. The portion of the surface 10, that faces it, is firstly substantially flat, then is curved, to re-join the axis 18.

The reference $11_2$ designates the most downstream part, in the conduit 7, of the lower wall 11. In the embodiment illustrated, the gutter has, as explained above, in a $2^{nd}$ part, the shape of a conduit sloping towards the top of the figure, this part $11_2$ being at a distance d from the plane of the nozzle plate 2 which decreases when the distance to the plane $P_0$ increases. The same applies to the portion of the wall 12 that is situated downstream of the line 18. In other words, the more a point, on the surface $11_2$ (respectively 12), is close to the plane $P_0$, the further away it is, also, from the plane of the plate 2. Preferably, this part $11_2$ forms a substantially flat portion of the lower wall 11. The portion of the surface 12, that faces it, is firstly, in the vicinity of the line 18, slightly curved then substantially flat.

It is in a zone situated between the lines 18 and 28, and in the vicinity of this zone, that the conduit 7 forms the restriction 38, which is going to make it possible to avoid a return of drops of ink to the cavity 5. This restriction 38 results, in this example, from the restriction in width then the change in orientation of the direction of the slope of the gutter 7, which is firstly inclined downwards, in the $1^{st}$ part $7_1$, then sloping upwards, in the $2^{nd}$ part $7_2$. The lowest section or width, in the sense explained above, of the gutter is situated in this restriction 38.

The operation of this cavity is that described above, but the restriction 38, formed in the vicinity of the lines 18 and 28, makes it possible to avoid a return of drops to the cavity 5. The other interests, in terms of operation, of the example of FIG. 3, have been mentioned above, with reference to the description of the structure.

In a variant, the gutter is of the type that has just been described, with reference to FIG. 3, but with the structure described with reference to FIG. 2A, with a lateral conduit 20 for injecting gas. Such an embodiment is represented in FIG. 4.

In a further variant (not represented), the gutter is of the type that has just been described, with reference to FIG. 3, but with the structure described with reference to FIG. 2B, with a conduit for injecting gas via the bottom of the cavity.

In the case of a structure with lateral injection of gas, and with a gutter of the type described with reference to FIG. 3, the inventors have carried out a simulation. To do so they selected conditions of inlet of air in the cavity 5 in order to obtain a vortex and applied Comsol® software. This software exploits a breakdown into finite elements of the cavity volume according to a certain meshing. A flow rate value and flow conditions inside the meshing elements in which one is interested are obtained. In the present case, a constraint relative to the direction of the vector-velocity at the level of the plane XZ has been added: this constraint is that the component of the vector-velocity of the gases in finite elements, containing a part of the plane XZ, is clearly greater than the component perpendicular to this plane. The direction of the printing drops is perturbed the least possible. In this way the flow of air along Y perturbs the least possible the path of the jets.

Figure 4:
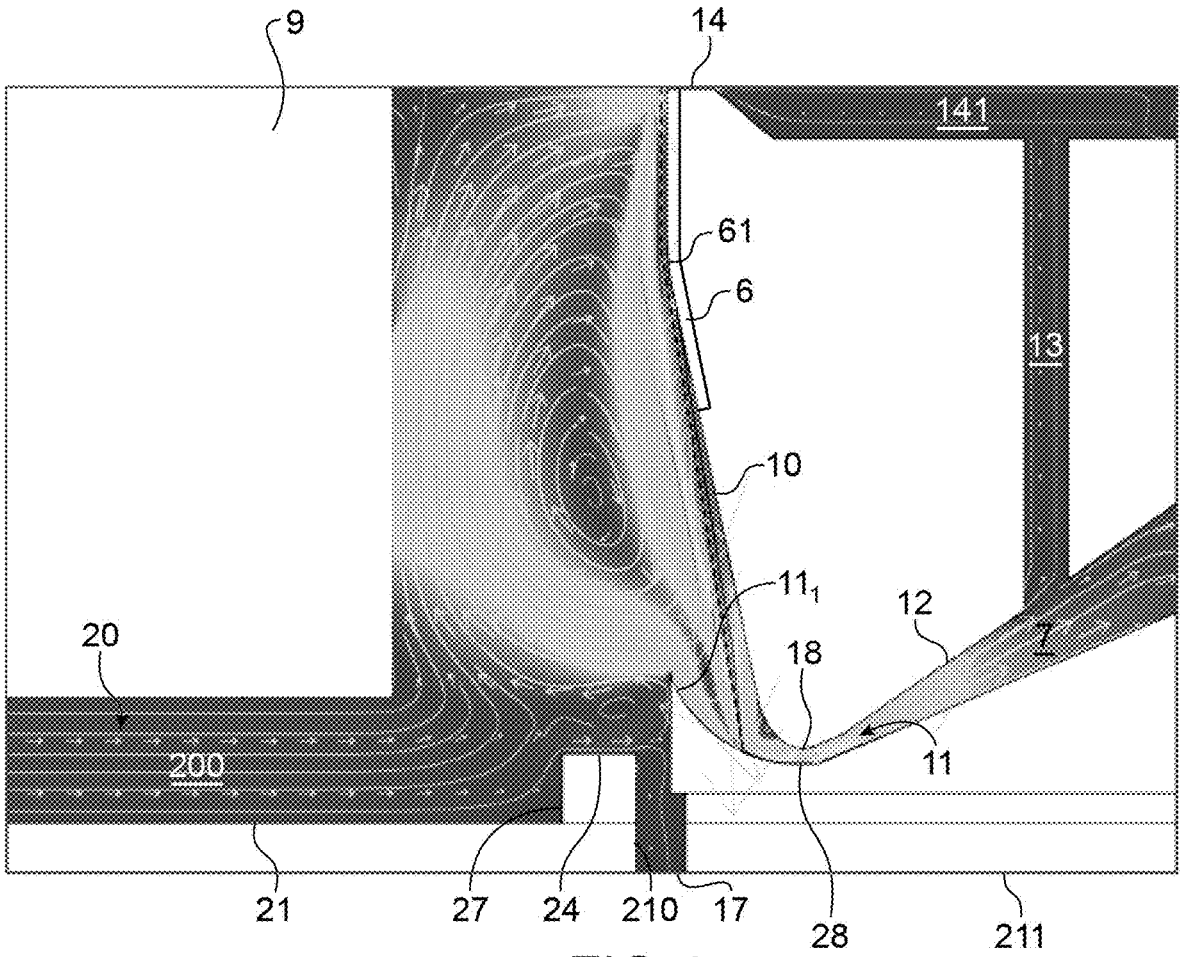
FIG. 4 represents another embodiment of a print head according to the invention as well as a simulation of circulation of air in this print head.

FIG. 4 represents the result of such a simulation. It may be seen that the gas, at the outlet of the conduit 20, is deviated towards the upper part of the cavity, circulates along the wall 9, re-joins the nozzle plate 2, then is brought back to the gutter 7.

The air circulates well around the point or the pressure area close to the external pressure (atmospheric pressure).

As will be understood from FIGS. 2A and 4, the circulation of air created in the cavity makes it possible to bring back, to the gutter, with the deviated flow of ink, solvent vapours present in the cavity. The positioning of the conduit 20 at the bottom of the cavity, on the side of the slot 17, makes it possible to obtain a path of the injected gas, firstly ascending in the cavity, to the plate 2, then descending, to the gutter 7.

Figure 5:
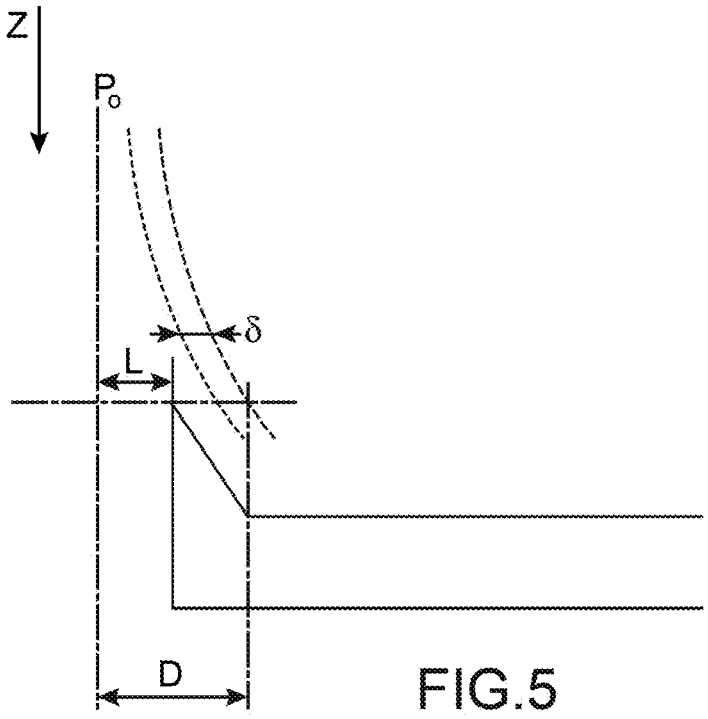
FIG. 5 represents a detail of a cavity of an embodiment of a print head according to the invention.

As illustrated in FIG. 5, whatever the shape of the gutter, the apex thereof is advantageously situated at a distance L from the plane $P_0$ less than or equal to the difference D in deviation of the jets, at the level of this apex (along the axis Z), reduced by the thickness δ of the boundary layer around the jets deviated at the level of this apex.

A device according to the invention is supplied with ink by a reservoir of ink not represented in the figures. Various fluidic connection means may be implemented to connect this reservoir to a print head according to the invention, and to recover ink that comes from the recovery gutter. An example of complete circuit is described in U.S. Pat. No. 7,192,121 and may be used in combination with the present invention.

Whatever the embodiment envisaged, the instructions, for activating the means $\mathbf{4}_1$-$\mathbf{4}_n$ for producing ink jets and the pumping means of the gutter, and/or the means for sending a gas into the cavity are sent by control means (also called "controller"). It is also these instructions that are going to make it possible to make ink circulate under pressure in the direction of the means $\mathbf{4}_1$-$\mathbf{4}_n$ then to generate jets as a function of the patterns to be printed on a support 8. These control means are for example realised in the form of a processor or a microprocessor, programmed to implement a method according to the invention.

It is this controller that drives the means $\mathbf{4}_1$-$\mathbf{4}_n$ the pumping means of the printer, and in particular the gutter, as well as the means for sending a gas into the cavity and/or the opening and the closing of valves in the path of the different fluids (ink, solvent, gas). The control means may also assure the memorisation of data, for example measurement data of ink levels in one or more reservoirs, and their potential processing.

Figure 6:
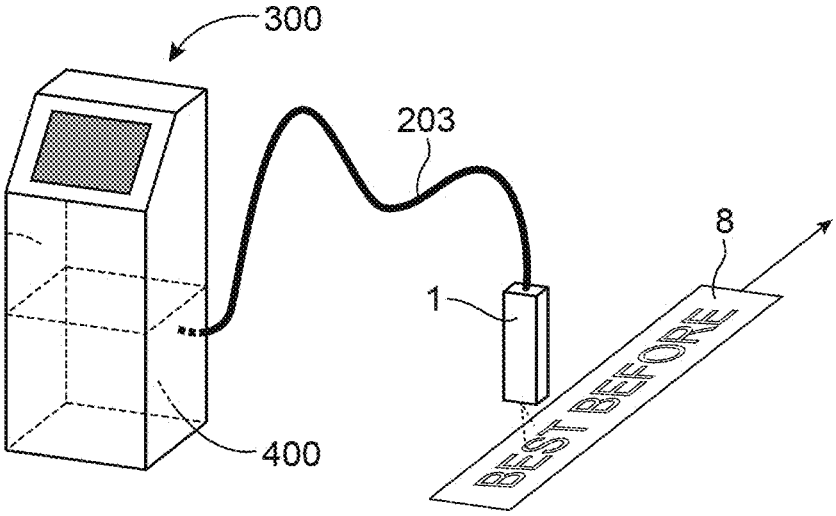
FIG. 6 represents the main units of an ink jet printer.

In FIG. 6 is represented the main units of an ink jet printer that can implement one or more of the embodiments described above. The printer comprises a console 300, a compartment 400 containing notably the circuits for conditioning the ink and solvents, as well as reservoirs for the ink and the solvents (in particular, the reservoir to which the ink recovered by the gutter is bought back). Generally, the compartment 400 is in the lower part of the console. The upper part of the console comprises the command and control electronics as well as visualisation means. The console is hydraulically and electrically connected to a print head 100 by an umbilical 203.

A gantry, not represented, makes it possible to install the print head facing a printing support 8, which moves along a direction materialised by an arrow. This direction is perpendicular to an axis of alignment of the nozzles.

The drop generator includes nozzles and a cavity of the type according to one of the embodiments described above.

The invention is particularly interesting in applications where the air or gas flow rate, in the cavity, is high, because a high air flow rate leads to an all the greater risk of solvent escaping.

For example, the flow rate may be of the order of several hundreds of l/h, again for example between 50 l/h or 100 l/h and 500 l/h, further for example around 300 l/h. These values apply notably to the case of a nozzle plate with 64 nozzles, but the invention also applies to the case of a nozzle plate with a fewer number of nozzles, for example 32, or in the case of a nozzle plate with a greater number of nozzles, for example 128. The velocity of the jets may be between 5 m/s and 20 m/s, for example it is around 15 m/s.

Figure 7:
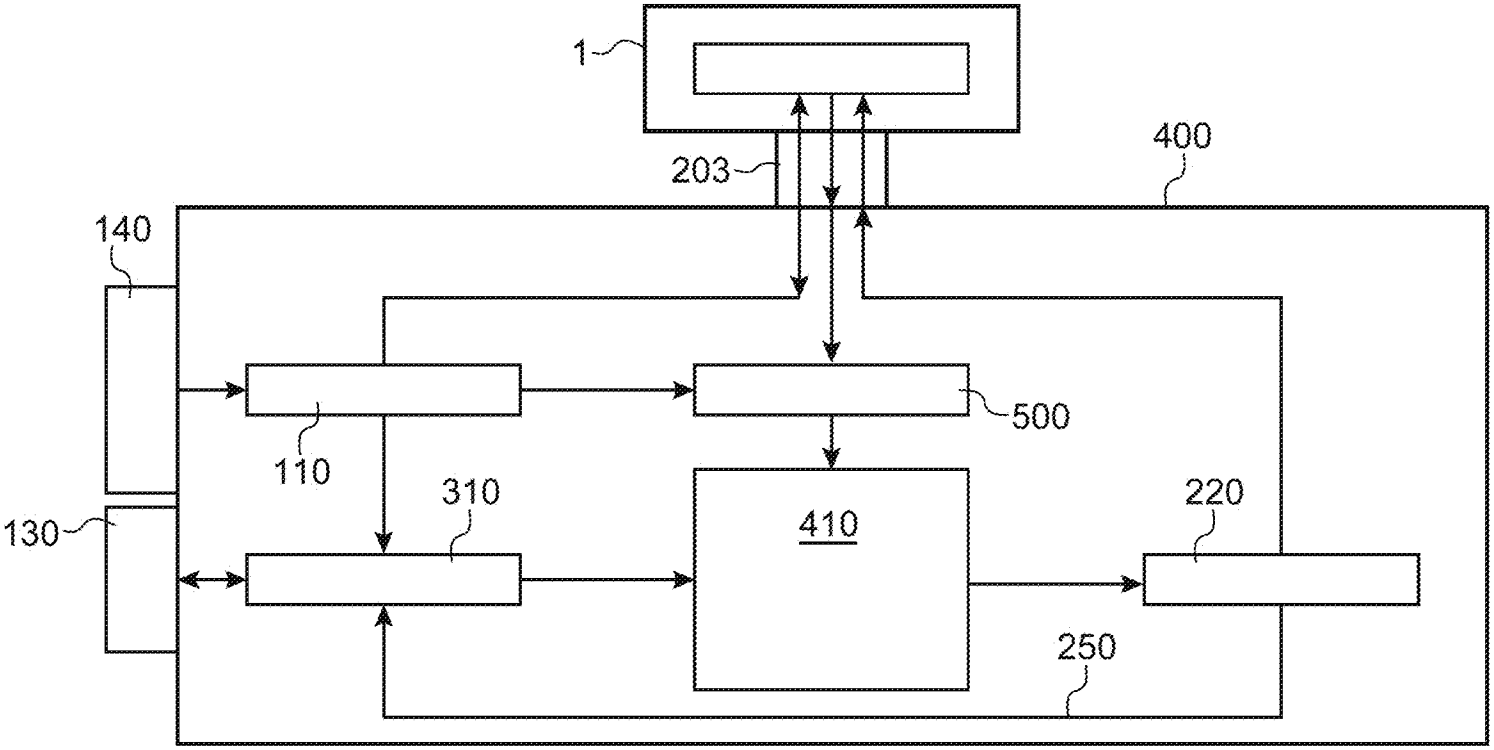
FIG. 7 represents a structure of an ink jet printer to which the present invention may be applied.

An example of fluidic circuit 400 of a printer to which the invention may be applied is illustrated in FIG. 7. This fluidic circuit 400 comprises a plurality of means 410, 500, 110, 220, 310, each associated with a specific functionality. The head 1 and the umbilical 203 are also illustrated.

With this circuit 400 are associated a removable ink cartridge 130 and a solvent cartridge 140, also removable.

The reference 410 designates the main reservoir, which makes it possible to receive a mixture of solvent and ink.

The reference 110 designates the set of means that make it possible to withdraw, and potentially to store, solvent from a solvent cartridge 140 and to provide the solvent thereby withdrawn to other parts of the printer, whether it involves supplying the main reservoir 410 with solvent, or cleaning or maintaining one or more of the other parts of the machine.

The reference 310 designates the set of means that make it possible to withdraw ink from an ink cartridge 130 and to provide the ink thereby withdrawn to supply the main reservoir 410. As may be seen in this figure, according to the embodiment presented here, the sending, to the main reservoir 410 and from the means 110, of solvent, goes through these same means 310.

At the outlet of the reservoir 410, a set of means, globally designated by the reference 220, makes it possible to pressurise the ink withdrawn from the main reservoir, and to send it to the print head 1. According to an embodiment, illustrated here by the arrow 250, it is also possible, by these means 220, to send ink to the means 310, then again to the reservoir 410, which enables a recirculation of ink inside the circuit. This circuit 220 also makes it possible to empty the reservoir in the cartridge 130 as well as to clean the connectors of the cartridge 130.

The system represented in this figure also comprises means 500 for recovering fluids (ink and/or solvent) that return from the print head, more exactly from the gutter 7 of the print head or the rinsing circuit of the head. These means 500 are thus arranged downstream of the umbilical 203 (with respect to the sense of circulation of the fluids that return from the print head).

As may be seen in FIG. 7, the means 110 may also make it possible to send solvent directly to these means 500, without going either through the umbilical 203 or through the print head 1 or through the recovery gutter.

The means 110 may comprise at least 3 parallel solvent supplies, one to the head 1, the $2^{nd}$ to the means 500 and the $3^{rd}$ to the means 310.

Each of the means described above is provided with means, such as valves, preferably electromagnetic valves, which make it possible to orient the fluid concerned to the chosen destination. Thus, from the means 110, it is possible to send the solvent exclusively to the head 1, or to the means 500 or to the means 310.

Each of the means 500, 110, 210, 310 described above may be provided with a pump which makes it possible to treat the fluid concerned (respectively: $1^{st}$ pump, $2^{nd}$ pump, $3^{rd}$ pump, $4^{th}$ pump). These different pumps assure different functions (those of their respective means) and are thus different to each other, even if these different pumps may be of the same type or of similar types (in other words: none of these pumps assures 2 of these functions). In particular, the means 500 comprise a pump ($1^{st}$ pump) that makes it possible to pump fluid, recovered, as explained above, from the print head, and to send it to the main reservoir 410. This pump is dedicated to the recovery of fluid coming from the print head and is physically different to the $4^{th}$ pumping means 310 dedicated to the transfer of ink or the $3^{rd}$ pumping means 210 dedicated to the pressurisation of ink at the outlet of the reservoir 410.

The means 110 comprise a pump (the $2^{nd}$ pump) that makes it possible to pump solvent and to send it to the means 500 and/or to the means 310 and/or to the print head 1.

Such a circuit 400 is controlled by the control means described above, these means are in general contained within the console 300 (FIG. 6).

The invention claimed is:

1. A print head of a binary continuous jet printer comprising:

a cavity delimited by a first wall, a second wall facing the first wall, and side walls extending between the first wall and the second wall, a plurality of n nozzles for producing a plurality of ink jets in said cavity, said n nozzles extending along an axis X between a first nozzle and a last nozzle, at least one electrode for separating one or more of said plurality of ink jets into drops or sections intended for printing and drops or sections not intended for printing, an outlet slot, which passes through the second wall, open on the outside of the cavity and enabling the exit of the drops or sections intended for printing, a gutter for recovering the drops or sections not intended for printing, said gutter comprising:

a first part, that comprises an inlet slot for the drops or sections not intended for printing, wherein a width of the first part diminishes in a direction of circulation of the drops or sections not intended for printing, and a surface of the first part forms an impact surface for the drops or sections not intended for printing;

a restriction having a width between 50 μm and 400 μm, wherein the impact surface slopes, with respect to a first plane (P0) defined by a path of the drops or sections intended for printing, from the inlet slot to the restriction;

a second part, for evacuating a gas, or a gas and liquid mixture, from the restriction, wherein the gutter has a shape in a second plane (YZ) perpendicular to axis X, and keeps the shape over a distance extending along the axis X from the first nozzle to the last nozzle, wherein the gutter has an upper surface and a lower surface that define the first part, second part, and restriction of the gutter, wherein the upper surface and lower surface both slope upward from a downstream end and an upstream end of the restriction, and wherein the second part has a width that increases from the restriction.

2. The print head according to claim 1, wherein the upper surface and lower surface of the first part delimit a volume that is, at least in part, concave.

3. The print head according to claim 1, wherein the first part and second part of the gutter slope from the restriction in opposite directions.

4. The print head according to claim 3, wherein the first part is sloping from the inlet slot toward a third plane that is perpendicular to a direction of the drops or sections intended for printing and that goes through the outlet slot, and the second part of the gutter is sloping from the restriction while moving away from the third plane as a distance of the second part from the restriction increases.

5. The print head according to claim 1, wherein the width of the restriction is between 50 μm and 300 μm.

6. The print head according to claim 1, said side walls being arranged on either side of the first plane (P0) and arranged at least partially parallel to the first plane (P0).

7. The print head according to claim 1, wherein said at least one electrode is arranged against, or in, one of said side walls.

8. The print head according to claim 7, wherein the inlet slot of the gutter is arranged at a bottom of the one of said side walls.

9. The print head according to claim 7, wherein a distance between the first plane ($P_0$) and a part of the one of said side walls in or against which the at least one electrode is arranged increases in a direction of the drops or sections intended for printing.

10. The print head according to claim 1, an edge of the gutter being situated directly in line with an edge of the inlet slot.

11. The print head according to claim 1, wherein a most upstream part the impact surface constitutes an apex of the gutter.

12. The print head according to claim 1, an apex of the gutter being situated at a distance L from the first plane ($P_0$), less than or equal to a difference in deviation of the drops or sections not intended for printing at the apex reduced by a thickness of a boundary layer around the drops or sections not intended for printing at the apex.

13. An ink jet printer comprising the print head according to claim 1 and an ink circuit for supplying said print head with ink.

14. The ink jet printer according to claim 13, further comprising a console comprising circuits for conditioning ink and solvent, as well as for containing reservoirs for ink and solvent and a controller, said console being hydraulically and electrically connected to said print head by an umbilical.

15. A method for operating the print head according to claim 1, in which the drops or sections of ink intended for printing are sent to the outlet slot, whereas the drops or sections not intended for printing are sent to the gutter where they are sucked up.

16. The method according to claim 15, in which a flow rate of a gas that circulates in the cavity is between 50 l/h and 500 l/h.

17. The print head according to claim 1, wherein the lower surface defines the restriction of the gutter, and the width of the restriction is measured along a plane perpendicular to the lower surface.

* * * * *